US010688493B2

(12) United States Patent
Kim et al.

(10) Patent No.: US 10,688,493 B2
(45) Date of Patent: Jun. 23, 2020

(54) INTEGRATED MICROFLUIDIC RECTIFIER FOR VARIOUS BIOANALYTICAL APPLICATIONS

(71) Applicant: Texas Tech University System, Lubbock, TX (US)

(72) Inventors: Jungkyu Kim, Lubbock, TX (US); Vladimir Coltisor, Lubbock, TX (US)

(73) Assignee: Texas Tech University System, Lubbock, TX (US)

( * ) Notice: Subject to any disclaimer, the term of this patent is extended or adjusted under 35 U.S.C. 154(b) by 405 days.

(21) Appl. No.: 15/454,948

(22) Filed: Mar. 9, 2017

(65) Prior Publication Data

US 2017/0259267 A1 Sep. 14, 2017

Related U.S. Application Data

(60) Provisional application No. 62/305,906, filed on Mar. 9, 2016.

(51) Int. Cl.

| | |
|---|---|
| ***B01L 3/00*** | (2006.01) |
| ***F04B 19/00*** | (2006.01) |
| ***F04B 45/08*** | (2006.01) |

(52) U.S. Cl.

CPC ..... *B01L 3/502784* (2013.01); *B01L 3/50273* (2013.01); *B01L 3/502738* (2013.01);

(Continued)

(58) Field of Classification Search

CPC ..... B01L 3/502784; B01L 3/502738; B01L 3/50273; B01L 2300/0816;

(Continued)

(56) References Cited

U.S. PATENT DOCUMENTS 6,632,619 B1 * 10/2003 Harrison ..... B01J 19/0093 422/504
6,808,075 B2 * 10/2004 Bohm ..... B07C 5/34 209/172.5

(Continued)

OTHER PUBLICATIONS

Christopher J. Hansen, et al.; High-Throughput Printing via Microvascular Multinozzle Arrays; Adv. Mater. 2013, 25, 96-102, 7 pages.

(Continued)

*Primary Examiner* — Shogo Sasaki

(74) *Attorney, Agent, or Firm* — Dickinson Wright PLLC; Kristopher Lance Anderson

(57) ABSTRACT

A device for performing a microfluidic assay on a chip comprising, a microfluidics chip, one or more fluid receptacles on the chip for receiving a fluid, a plurality of pneumatic pumps arrayed on the chip, each pump having a discharge channel leading to a rectifier on the chip, and a reaction chamber in fluid communication with each of the rectifiers, wherein a pressure on the pressurized fluid source drives fluid from the fluid receptacle into the incoming fluid channel connecting the fluid receptacle to the pump, through the pump and into the discharge channel, through the discharge channel to the rectifier, and through the rectifier into the reaction chamber, wherein the pump is configured to generate droplets of a pre-determined size, wherein the rectifiers prevent backflow of the droplets, and wherein droplets are combined in the reaction chamber, the chamber facilitating an assay being performed on the chip.

13 Claims, 7 Drawing Sheets

(52) U.S. Cl.
CPC ..... *F04B 19/006* (2013.01); *F04B 45/08* (2013.01); *B01L 2200/06* (2013.01); *B01L 2200/0673* (2013.01); *B01L 2300/023* (2013.01); *B01L 2300/0816* (2013.01); *B01L 2300/0867* (2013.01); *B01L 2400/049* (2013.01); *B01L 2400/0481* (2013.01); *B01L 2400/0666* (2013.01)

(58) Field of Classification Search
CPC ..... B01L 2200/0673; B01L 2200/06; B01L 2400/0481; B01L 2400/0666; B01L 2400/049; B01L 2300/0867; B01L 2300/023; F04B 19/006; F04B 45/08
See application file for complete search history.

(56) References Cited

U.S. PATENT DOCUMENTS

2005/0164372 A1* 7/2005 Kibar ..... G01N 30/00 435/287.1
2005/0207940 A1* 9/2005 Butler ..... B01L 3/502761 422/73
2006/0094119 A1* 5/2006 Ismagilov ..... B01F 13/0071 436/55
2007/0003442 A1* 1/2007 Link ..... G01N 15/1484 422/400
2007/0172954 A1* 7/2007 Ismagilov ..... B01F 5/0646 436/53
2008/0213821 A1* 9/2008 Liu ..... B01L 3/502761 435/39
2008/0261295 A1* 10/2008 Butler ..... B01L 3/502761 435/286.5

OTHER PUBLICATIONS

Yun Kyung Jung, et al.; Microfluidic Arrays for Direct Genotyping of Clinical Samples; Biosensors and Bioelectronics 79 (2016) 371-378, available online Dec. 21, 2015, 8 pages.
Yun Kyung Jung, et al.; Microfluidic Linear Hydrogel Array for Multiplexed Single Nucleotide Polymorphism (SNP) Detection; American Chemical Society, Anal. Chem. 2015, 87, 3165-3370, Published Feb. 12, 2015, 6 pages.
Nicole Pamme; Continuous Flow Separations in Microfluidic Devices; The Royal Society of Chemistry 2007, Lab Chip, 2007, 7, 1644-1659, first published as an advance article on the web Nov. 2, 2007, 16 pages.
[0063] Pamme, Nicole; Continuous Flow Separations in Microfluidic Devices, Nov. 2, 2007; Lab Chip 2007, 7, 1644-1659.
[0064] Hansen, Christopher J., et al.; High-Throughout Printing Via Microvascular Multinozzle Arrays (Actuators and Microfluidic Single or Multinozzle(s) for 3D Printer); 2013; Adv. Mater. 2013, 25, 96-102.
[0065] Jung, Yun Kyung, et al.; Microfluidic Hydrogel Arrays for Direct Genotyping of Clinical Samples (In-Situ Hydrogel Array Fabrication by Laminar Flow Regime with Rectified Pulsatile Micropump); 2016; Anal. Chem., vol. 87, 3165-70, 2015; Biosensors and Bioelectronics, vol. 79, May 15, 2016, Pages 371-378.

* cited by examiner

INTEGRATED MICROFLUIDIC RECTIFIER FOR VARIOUS BIOANALYTICAL APPLICATIONS

CROSS-REFERENCE TO RELATED APPLICATIONS

This application claims priority to U.S. Patent Appl. Ser. No. 62/305,906, filed Mar. 9, 2016, entitled "INTEGRATED MICROFLUIDIC RECTIFIER FOR VARIOUS BIOANALYTICAL APPLICATIONS." The foregoing patent application is hereby incorporated herein by reference in its entirety for all purposes.

This application includes material that is subject to copyright protection. The copyright owner has no objection to the facsimile reproduction by anyone of the patent disclosure, as it appears in the Patent and Trademark Office files or records, but otherwise reserves all copyright rights whatsoever.

TECHNICAL FIELD

The present disclosure relates in general to microfluidic pumps. In particular, the system of the present disclosure provides for a microfluidic-based, droplet generator. The disclosed systems and methods support a wide variety of scenarios for quantitative biomedical research and related products and services.

STATEMENT OF FEDERALLY FUNDED RESEARCH

None.

BACKGROUND OF THE DISCLOSURE

Microfluidics allows for the production of droplets with a precise control and reproducibility over the experiment's parameters. This precise control enables the generation of size-controlled and high monodispersity droplets. Droplets generation has a large scale of applications, such as emulsion production, single cell analysis, drug delivery or nanoparticles synthesis. Droplets can also be used as micro bioreactors for chemical or biochemical reactions.

Droplet generators are excellent tools for generating highly reproducible microsized droplets with much higher precision and repeatability compared to conventional methods. This technology has been well developed and utilized as a quantitative biomedical research tool. The disclosed technology is a syringe-pump free portable droplet generator designed to generate droplets by on-chip micropump array and programmable for different sized droplet generation. Conventional droplet generators require bulky syringe pumps and tubing which results in them being heavy and large in dimension (up to 100 lb and 2×2×2 feet in dimensions). As a result of the heavy weight and large dimension, conventional droplet generators are limited to specific on-site point of care diagnostics.

Currently, no syringe-free portable droplet generator exist designed to generate droplets by on-chip micropump array and programmable for different sized droplet generation. Most conventional droplet generation system is made up of syringe pumps with continues flow of liquids to create the droplets. As a result, throughput-multiplexing capability of these traditional droplet generators are limited by number of syringe pumps.

Despite advances in the art, there remains a need to improve point of care testing capabilities for the microfluidic chip platform.

SUMMARY OF THE DISCLOSURE

It is therefore an object of the present disclosure to provide a method to generate droplets from a syringe-free portable droplet generator using pneumatic pumps controlled by a computer. Various micro- and nano-liter sized droplets can be easily generated for drug test without any expensive syringe pumps. The portability and ease of use makes it a promising technology easy to use by non-technical persons. The present disclosure is capable of fitting in a 6×6×10 inch box and can weigh about 5 lb. This reduction in weight and size makes it a better fit to be used in high-throughput, portable chemical and biological analysis that require on-site application.

It is another object of the present disclosure to provide various micro- and nano-liter sized droplets which can be easily generated for drug test and biological and chemical assays without using expensive syringe pumps. The portability and ease of use makes it promising for using by non-technical persons and carry it for generating test results on-site.

The system of the present disclosure omits use of expensive and bulky syringe pumps in a droplet generator system. The significant reduction in weight and reduction in size make it more miniaturized and suitable for batch fabrication. In addition, throughput multiplexing capability of the traditional droplet generation solely is limited by number of syringe pumps. For the RMP droplet generator, this scalability issue can be resolved by adding more pumps in microfluidic chip platform. The novel feature of the present invention is its droplet generation by on-chip micropump array and programmable different sized droplet generation. In another aspect of the present invention, a rectifier is utilized to prevent backflow. Current technologies require bulky syringe pumps, which require lot of space thus limits droplet generation from being portable. In another aspect of the invention, the present disclosure uses pneumatic pumps controlled by a computer to pulse and create the droplets, so this issue is resolved simply by adding more pumps in the microfluidic chip platform.

It is therefore an object of the present invention to provide a device for performing a microfluidic assay on a chip comprising: a microfluidics chip; one or more fluid receptacles on the chip, each receptacle configured for receiving a single fluid, and each receptacle capable of being in fluid communication with a pressurized fluid source; a plurality of pneumatic pumps arrayed on the chip, each pump being in fluid communication with one of the fluid receptacles via an incoming fluid channel, each pump having a discharge channel leading to a rectifier on the chip; and a reaction chamber on the chip connected to and configured to communicate with one or more rectifier; wherein a pressure from the pressurized fluid source drives the single fluid from each fluid receptacle into its incoming fluid channel and to its pump, through the pump and into its discharge channel, through the discharge channel to one of the rectifiers, and through the rectifier into the reaction chamber; and wherein each pump is configured to generate droplets of the single fluid of a pre-determined size; wherein the rectifiers prevent backflow of the droplets; and wherein droplets of the one or more fluids are combined in the reaction chamber, the chamber facilitating an assay being performed on the chip.

Optionally, the pneumatic pumps are pulsatile pumps. Optionally, the droplets are of a size from low picoliters to high nanoliters. Optionally, the assay being performed is a cell screening assay, a directed evolution assay, a nucleic acid analysis, immunoassay, or drug screening. Optionally, each rectifier is a diodic rectifier. In one aspect, each discharge channel further comprises at least one passive rectifier.

In one aspect, each discharge channel further comprises a plurality of passive rectifiers, which may be further configured to prevent any backflow from being generated in the discharge channel.

Optionally, the pneumatic pump of the present invention is a peristaltic pump. The pressurized fluid source may further comprise a vacuum pump and a solenoid valve system. The device may further comprise each rectifier as a diodic rectifier, each diodic rectifier being connected to a DC powered diodic pump configured to cause a pneumatic pressure on the rectifier.

The present invention may further include a controller function, wherein the controller function is operated by a computer processor in a remote computer, which may further comprise a monitoring function, wherein the monitoring function is operated by a computer processor in a remote computing device capable of sending or receiving signals.

It is another object of the present invention to provide a method of performing an assay on a microfluidics chip comprising: delivering, from a pressurized fluid source, one or more fluids to one or more fluid receptacles located on a microfluidics chip, each receptacle configured to receive a single fluid, and each receptacle being in fluid connection with a pneumatic pump via an incoming fluid channel; forcing, via pressure from the pressurized fluid source, the one or more fluids from the one or more receptacles, through its incoming fluid channel, and to its pump, wherein each pump is configured to generate droplets of the single fluid of a pre-determined size; forcing, via pressure from the pressurized fluid source, the droplets of each single fluid into a discharge channel in fluid connection with its pump, to a rectifier in fluid connection with one or more of the discharge channels; directing the droplets through the rectifiers and into a reaction chamber that is in fluid connection with and in communication with each rectifier; and combining droplets from the one or more fluids in the reaction chamber to facilitate an assay being performed on the chip.

Optionally, the rectifier is a diodic rectifier. Optionally, each discharge channel further comprises at least one passive rectifier, or alternatively, each discharge channel further comprises more than one passive rectifier.

Optionally, the assay being performed is a cell screening assay, a directed evolution assay, a nucleic acid analysis, immunoassay, or drug screening.

BRIEF DESCRIPTION OF THE DRAWINGS

The foregoing and other objects, features, and advantages of the disclosure are apparent from the following description of embodiments as illustrated in the accompanying drawings, in which reference characters refer to the same parts throughout the various views. The drawings are not necessarily to scale, emphasis instead being placed upon illustrating principles of the disclosure.

DETAILED DESCRIPTION OF THE DISCLOSURE

Figure 1:
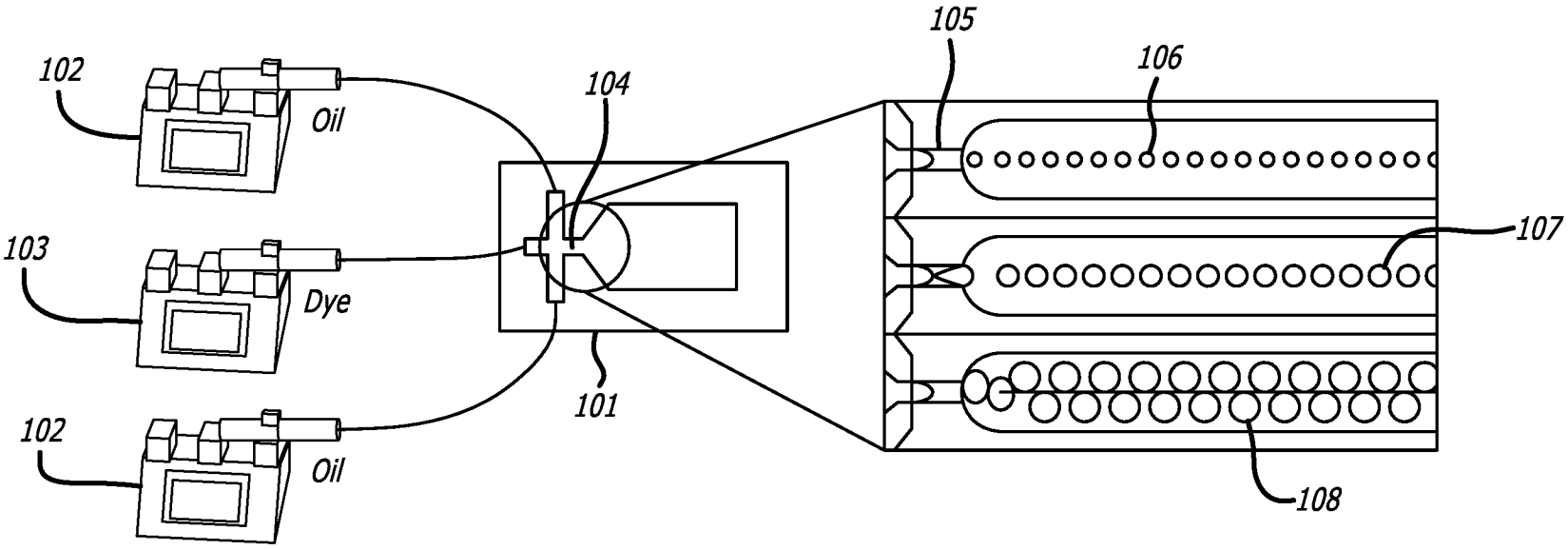
FIG. 1 (Prior Art)
FIG. 1 depicts a prior art system of traditional syringe pump—driven droplet generator.

While the making and using of various embodiments of the present disclosure are discussed in detail below, it should be appreciated that the present disclosure provides many applicable inventive concepts that can be embodied in a wide variety of specific contexts, goods, or services. The specific embodiments discussed herein are merely illustrative of specific ways to make and use the disclosure and do not delimit the scope of the disclosure.

All publications and patent applications mentioned in the specification are indicative of the level of skill of those skilled in the art to which this disclosure pertains. All publications and patent applications are herein incorporated by reference to the same extent as if each individual publication or patent application was specifically and individually indicated to be incorporated by reference.

The present disclosure will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Turning to the present disclosure, including FIGS. 1-7, a syringe-free, portable droplet generator system is provided, comprising an on-chip micropump array having pneumatic pump capable of generating various micro and nano-liter sized droplets without the requirement of large syringe pumps. The system of the present invention utilizes single pulsatile pump configurations wherein one or more pneumatic pumps generate the desired droplet size.

Droplet-based microfluidic devices use micron-scale drops as "test tubes" for biological reactions. This allows biological reactions to be performed with greatly enhanced speed and efficiency over conventional approaches: by reducing the drop volume, only picoliters of reagent are needed per reaction, while through the use of microfluidics, the reactions can be executed at rates exceeding hundreds of kilohertz. This combination of incredible speed and efficient reagent usage is attractive for a variety of applications in biology, particularly those that require high-throughput processing of reactions, including cell screening, directed evolution, and nucleic acid analysis. The same advantages of speed and efficiency would also be beneficial for applications in the field, in which the amount of material available for testing is limited, and results are needed with short turnaround. However, a challenge to using these techniques in field applications is that the control systems developed to operate the devices are intended for use in the laboratory: to inject fluids, mechanical pumps such as syringes are needed, while computers must adjust flow rates to maintain optimal conditions in the device. In addition to significantly limiting the portability of the system, these qualities make them impractical for use outside the laboratory. For droplet-based microfluidic techniques to be useful for applications in the field, a general, robust, and portable system for operating them is needed.

By utilization of pneumatic pumps organized in an on-chip array, customized and numerous configurations for droplet generation are enabled. In one embodiment, the pumps are peristaltic pumps operating in pulsatile fashion. In a further embodiment, the pumps further include a diodic valve. Diodes are commonly referred to in electronics as a two-terminal electronic component that conducts primarily in one direction (asymmetric conductance); having low (ideally zero) resistance to the flow of current in one direction, and high (ideally infinite) resistance in the other. The most common function of a diode is to allow an electric current to pass in one direction (called the diode's forward direction), while blocking current in the opposite direction (the reverse direction). Thus, the diode can be viewed as an electronic version of a check valve. This unidirectional behavior is called rectification, and these diodes are forms of rectifiers. This design differs from existing fluidic rectifiers or diodes as it functions on a passive and active rectifier system. It is therefore one embodiment of the present invention to provide a "rectifier" which is derived from applying the principle of a transistor to a fluidic circuit, comprised of a passive channel structure and an active pressure driven pneumatic lifting gate structure. The applied pressure to the lifting gate structure makes it necessary for the pressure in the channel to overcome the applied pressure for forward flow to be generated while the passive structure diffuses the backflow. This design creates a flow profile with zero backflow and gives the ability to also control dispersed volumes by controlling the applied pressure on the lifting gate structure (active rectifier).

Thus, consistent with microfluidic rectifiers, the rectifier of the present invention comprises an inlet, and output channel, and various flow paths capable of droplet generation for ultimate use and observation via a pre-defined channel or reaction chamber.

Utilizing this diodic pattern, a flow profile of a microfluidic flow by preventing the backward flow typically associated with the use of pneumatic, pumps—primarily from the open and close action generating the forward flow. The used of the diodic-based pump, or check valve, allows for reduction of the backward flow of the microfluidic system.

For the purposes of the present disclosure, fluid flow or communication (hereinafter referred to as fluid communication) represents a connection between a first chamber and a second chamber separated by through a permeable, non-permeable, blocked, partially blocked, permeable or semi-permeable throughput.

A fluid receptacle represents certain reservoir utilized in a microfluidic context, including but not limited to: a well, cartridge, chamber, microwells, plates, channels, and the like, receptacle configured for receiving a single fluid, and each receptacle capable of being in fluid communication with a pressurized fluid source via the use of one or more pumps a further described herein. The fluid receptacle may further comprise an incoming fluid channel, wherein fluid is provided into the fluid receptacle, and each pump having a discharge channel, wherein fluid is vacated or discharged from the pump, leading to a rectifier on the chip;

In another embodiment, peristaltic pumps are utilized. A peristaltic pump is a type of positive displacement pump used for pumping a variety of fluids. A rotor with a number of "rollers", "shoes", "wipers", or "lobes" attached to the external circumference of the rotor compresses the flexible tube. As the rotor turns, the part of the tube under compression is pinched closed, or occludes thus forcing the fluid to be pumped to move through the tube. Additionally, as the tube opens to its natural state after the passing of the cam ("restitution" or "resilience") fluid flow is induced to the pump. Typically, there will be two or more rollers, or wipers, occluding the tube, trapping between them a body of fluid. The body of fluid is then transported, at ambient pressure, toward the pump outlet. Peristaltic pumps may run continuously, or they may be indexed through partial revolutions to deliver smaller amounts of fluid.

In another embodiment, the system of the present disclosure utilizes a miniature vacuum pump and solenoid valve rather than conventional syringe-based droplet generators, allowing for portable, high-throughput chemical and biological analyses required for on-site point of care diagnostics, and the like. The droplet generator is then reduced to slide glass sized microchip size which is then actuated by the miniature vacuum pump and solenoid valve system. The active rectifier requires that it have its own separate pressure control as to not interfere with the main solenoid configuration and to allow for manual pressure control. This pressure control system is a DC power diodic pump which causes pneumatic pressure on the active rectifier's lifting gate structure. Manual pressure control is required on the active rectifier so that it may be tuned depending on desired volume dispersion and channel pressure. Standard solenoid values are used for actuation to generate pulsatile flow.

In another embodiment, the droplet generator system of the present disclosure is controlled by a computer processor and can be implemented by means of analog or digital hardware and computer program instructions. These computer program instructions can be provided to a processor of a general purpose computer, special purpose computer, ASIC, or other programmable data processing apparatus, such that the instructions, which execute via the processor of the computer or other programmable data processing apparatus, implement the functions/acts specified, such as solution loading, droplet generation, and channel cleaning. In some alternate implementations, the functions/acts noted herein can occur out of the order noted.

These computer program instructions can be provided to a processor of a general purpose computer, special purpose computer, ASIC, or other programmable data processing apparatus, such that the instructions, which execute via the processor of the computer or other programmable data processing apparatus, implement the functions/acts specified for droplet generation and related functions with regard to operation of the microfluidic system, which may be a diagnostic, sensor, or other point of care device.

For purposes of this disclosure, a monitoring (or sensor or user) device may include an instrument such as a sensor, which may further include computing device capable of sending or receiving signals, such as via a wired or a wireless network. A monitoring device may, for example, include a desktop computer or a portable device, such as a cellular telephone, a smart phone, a display pager, a radio frequency (RF) device, an infrared (IR) device an Near Field Communication (NFC) device, a Personal Digital Assistant (PDA), a handheld computer, a tablet computer, a laptop computer, phablets, intelligent clothing, a set top box, a wearable computer, an integrated device combining various features, such as features of the forgoing devices, or the like.

A monitoring device may vary in terms of capabilities or features. Claimed subject matter is intended to cover a wide range of potential variations. For example, a device may include a numeric keypad or a display of limited functionality, such as a monochrome liquid crystal display (LCD) for displaying text. In contrast, however, as another example, a web-enabled monitoring device may include one or more physical or virtual keyboards, mass storage, one or more gas sensors, thermometers, barometers, fire detector, accelerometers, one or more gyroscopes, global positioning system (GPS) or other location-identifying type capability, or a display with a high degree of functionality, such as a touch-sensitive color 2D or 3D display, for example. In one embodiment, as a sample has been delivered via a droplet and aligned with a spot on the microfluidic diagnostic device, the sample will flow through a pre-defined channel and react with a pre-functionalized location, such as with an enzyme. After reaction, the results of the test can be determined and displayed to the user of the computing device via a display such as for providing real-time results in remote locations.

Many microfluidic pumps use pulsatile flow to deliver discrete volumes to specific target locations. Backflow within pulsatile microfluidic pumps can have an adverse effect on droplet generation and cause unwanted mixing due to breakdown of laminar flow boundaries. A fluidic diode, such as with the present invention provides a rectifying effect and restricts backflow allowing for a much more precise flow pattern. Fluidic rectifying structures have been proposed in the past however, many of them work at high Reynolds numbers. Microfluidic rectifiers tend to be for continuous flow and pulsatile flow diodes tend to be mostly lifting gate structures and flap structures. None of these structures eliminate backflow completely. Thus it is one embodiment of the present invention to provide a fluidic rectifier comprised of active and passive components that not only remove all backflow but also allows for control over dispersed volume.

In an exemplary embodiment, a passive microfluidic rectifier in the shape of a triangle with a base of 198 μm and a height of 210 μm and an active microfluidic rectifier along with three consecutive microfluidic valves were fabricated using soft lithography technique. Two polydimethylsiloxane (PDMS) layers, which are pneumatic and fluidic structures, were designed and manufactured with 10:1 PDMS and then these layers were bonded after an oxygen plasma treatment. As a final step, this assembled PDMS structure was bonded on an oxygen plasma treated glass slide. Pneumatic actuation of lifting gate structures was used to create pulsatile flow and a diodic pump with differential voltage control supplied pneumatic actuation to the active rectifier. A flow sensor was used to generate flow profiles of each micropump and rectifier structure.

This exemplary microfluidic rectifier was then tested under various pulsatile flow conditions which were generated by the three microfluidic valves. Different pressures which were used to optimize flow patterns and characterization. Outflow profiles from the microfluidic rectifier were then compared with the output profiles which were obtained from the microfluidic channel without the rectifier structure. Flow data that was collected from both was compared after normalization. Decrease in backflow was observed when using the fluidic diode as is evidenced by the Figures. In certain examples, when flow profiles were generated backflow in the straight channel was 40.00% out of total volumetric flow per cycle. The passive rectifier was able to reduce the backflow to 25.34% out of total volumetric flow, and with the addition of the active microfluidic rectifier there was no backflow on the pulsatile flow profile. Using this microfluidic rectifier, a droplet generation requiring a continuous forward flow was demonstrated and quality of drops were characterized by measuring polydispersity index. By comparison of this index, we found that the index from the microfluidic rectifier show a similar index from the index acquired from syringe pump based droplet generator. This microfluidic rectifier can be used in any fluidic system requiring zero backflow, which can be a substitute for syringe pumps. This zero backflow platform can also be used for a portable droplet generator which would simplify the complexity of current droplet platforms.

Turning to the figures below, illustrative embodiments of the present disclosure are provided. FIG. 1 presents prior art system of traditional syringe pump—driven droplet generator. These typical systems utilize syringe pumps for oil 102 and a dye 103 which inject the applicable fluid into the chip-based system 101 having an inlet 104 for production of multiple droplet configurations 106, 107, 108 via the applicable pre-defined droplet generator 105. A typical microfluidic device comprises a body of polydimethylsiloxane (PDMS) which comprises one or more microfluidic channels or flow paths. Pumps, valves, or combinations thereof cooperate with a controller to regulate the flow and eventual collection or generation of certain fluids for use in a predetermined channel or reaction chamber for various uses, including observation and analysis. One or more fluid inlets are positioned to interface with the one or more microfluidic channels. These microfluidics platforms may be formed using traditional techniques, and mass production is highly feasible by using injection molding or micro-imprinting technique to make a plastic based microchip.

Figure 2:
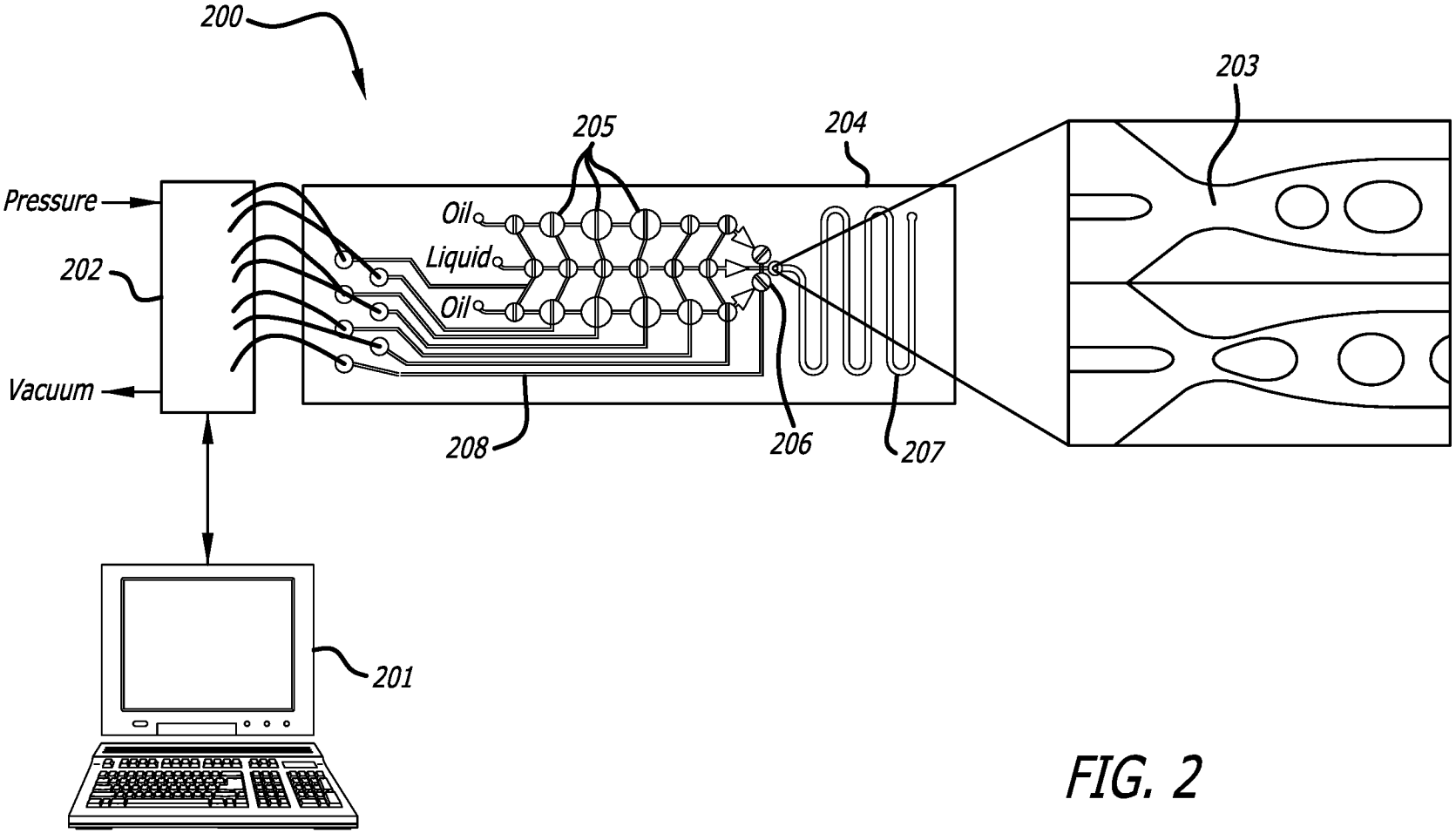
FIG. 2 depicts a demonstrative pneumatic pump driven array of the present disclosure.

Turning to the present invention, FIG. 2 depicts a demonstrative pneumatic pump driven array 200 of the present disclosure capable of being controlled via computing device 201; comprising fluid flow being induce to the pump via pressure applied to solenoid valves 202 to drive fluid in the array 200 multiple pneumatic pumps 205 are capable of driving pressure through the pre-defined channels 208. The pneumatic pumps 205 drive the fluid through one or more diodic rectifiers 206, to the applicable droplet generator 204. The resulting droplets are capable of flowing through a pre-defined channel 207 for reaction, localization, or detection.

Figure 3:
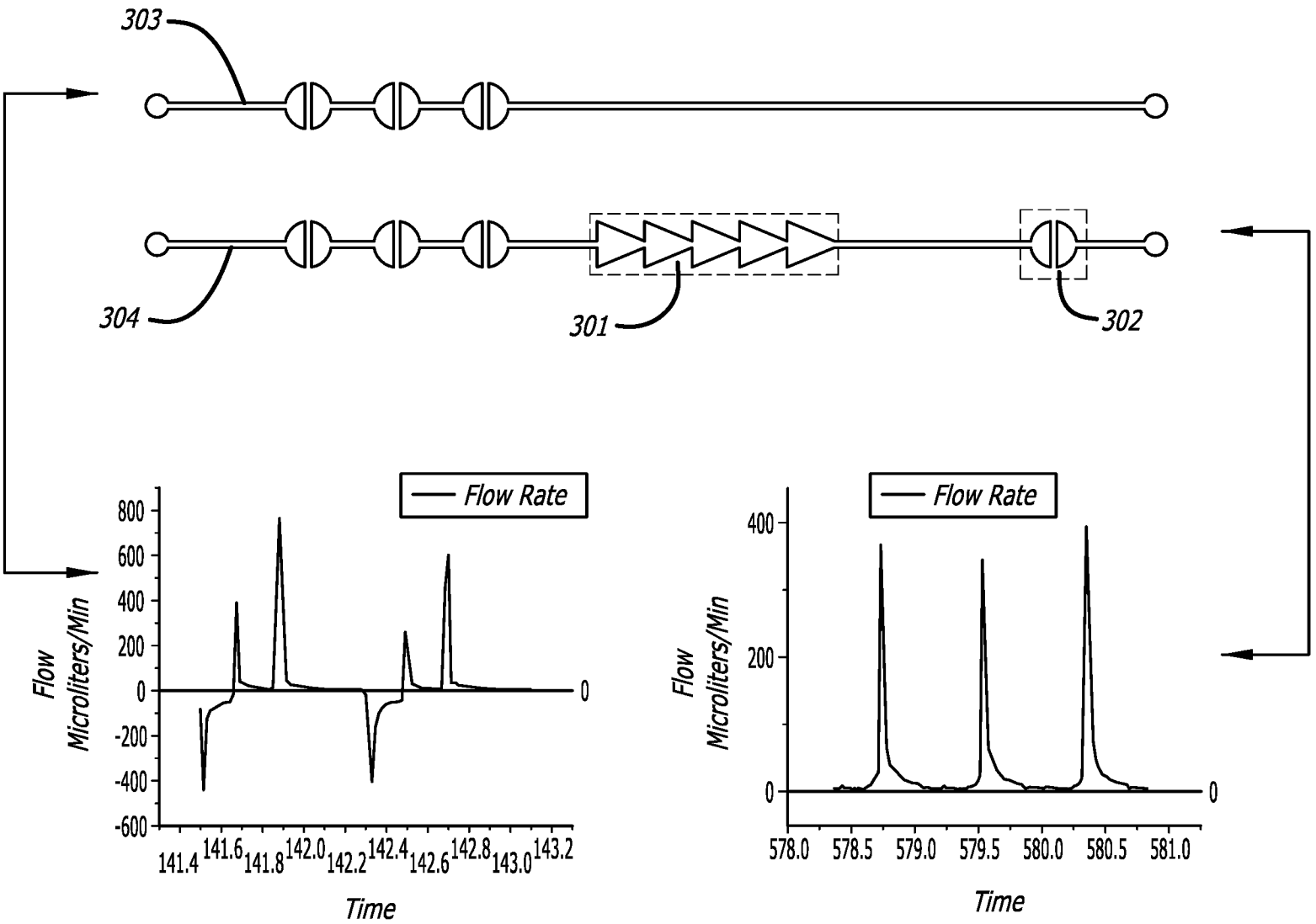
FIG. 3 depicts a comparison of a rectifier versus no rectifier, and related data showing backflow within microchannels.

FIG. 3 depicts a comparison of a microchannels 303, 304 with accompanying flow rate graphs, wherein one microchannel 303 lacks rectifiers, and the other microchannel 304 comprises both and passive rectifier 301 and active rectifier 302. The graphs illustrate flow rates in microliters per minute. The graphical representations of the flow rates show that, in measuring flow rate of the microchannel 303 without rectifiers, there is measured backflow within the microchannel 303. The microchannel 304 having both passive rectifier 301 and active rectifier 302, shows flow rate to have no backflow within the microchannel 304.

Figure 4:
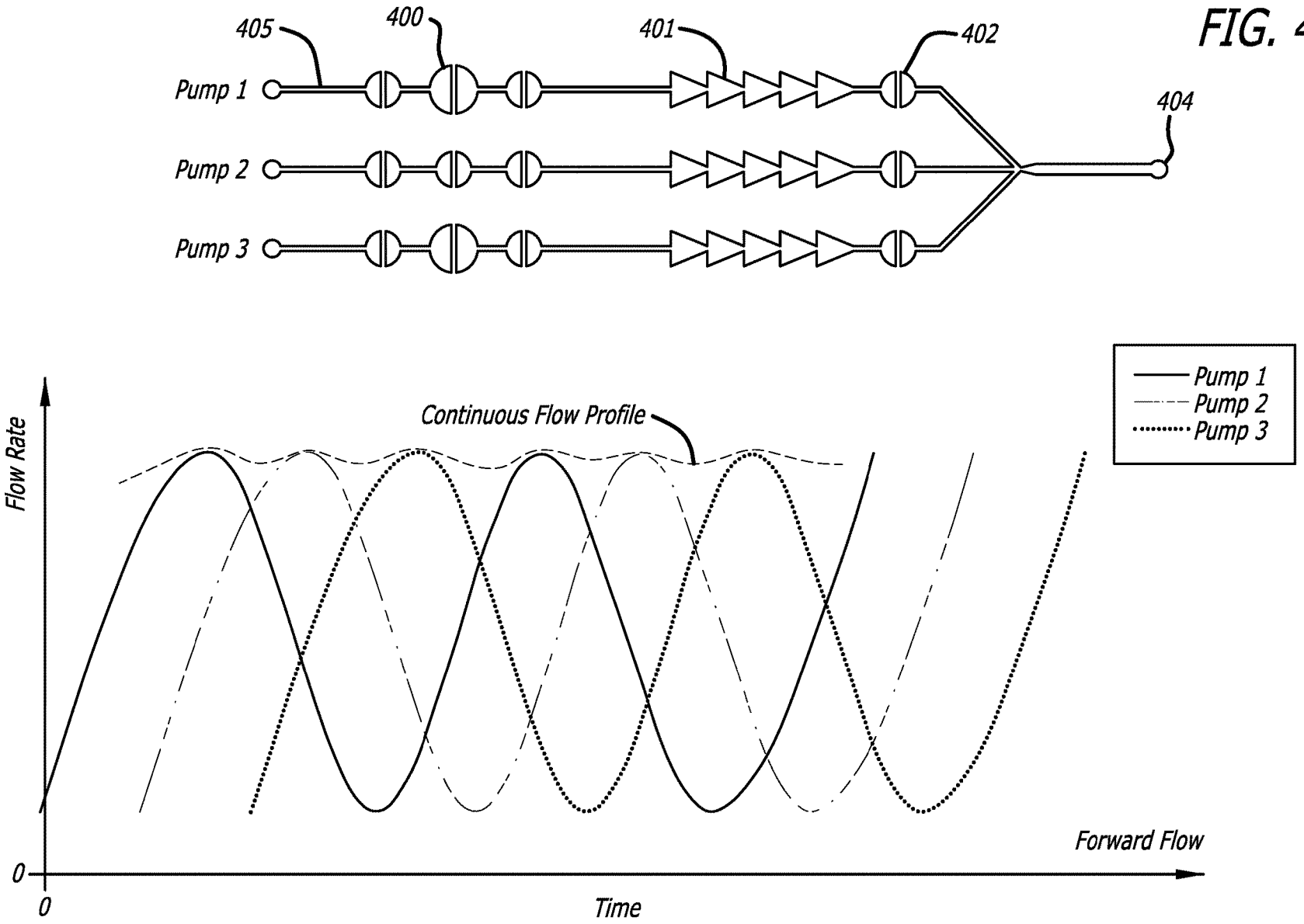
FIG. 4 depicts a graphical description of the flow profile of the drop generator having multiple pumps with diodic valves.

FIG. 4 presents a microchannel schematic and graphical description of the flow profile of the drop generator with diodic valves 402. The droplet generator comprises three pumps (Pump 1, Pump 2, and Pump 3) capable of droplet generation, each pump having a channel 405 for fluid flow introduction, such as via a solenoid valve, one or more pneumatic pumps 400, and one or more rectifiers, which may include a passive rectifier 401 or active rectifier 402 to then be disposed in the pre-defined channel 404 for use The resulting fluid flow analysis graph of FIG. 4 provides an exemplary continuous flow profile when effectively controlling the rate and volume of each of Pump 1, Pump 2 and Pump 3.

Figure 5:
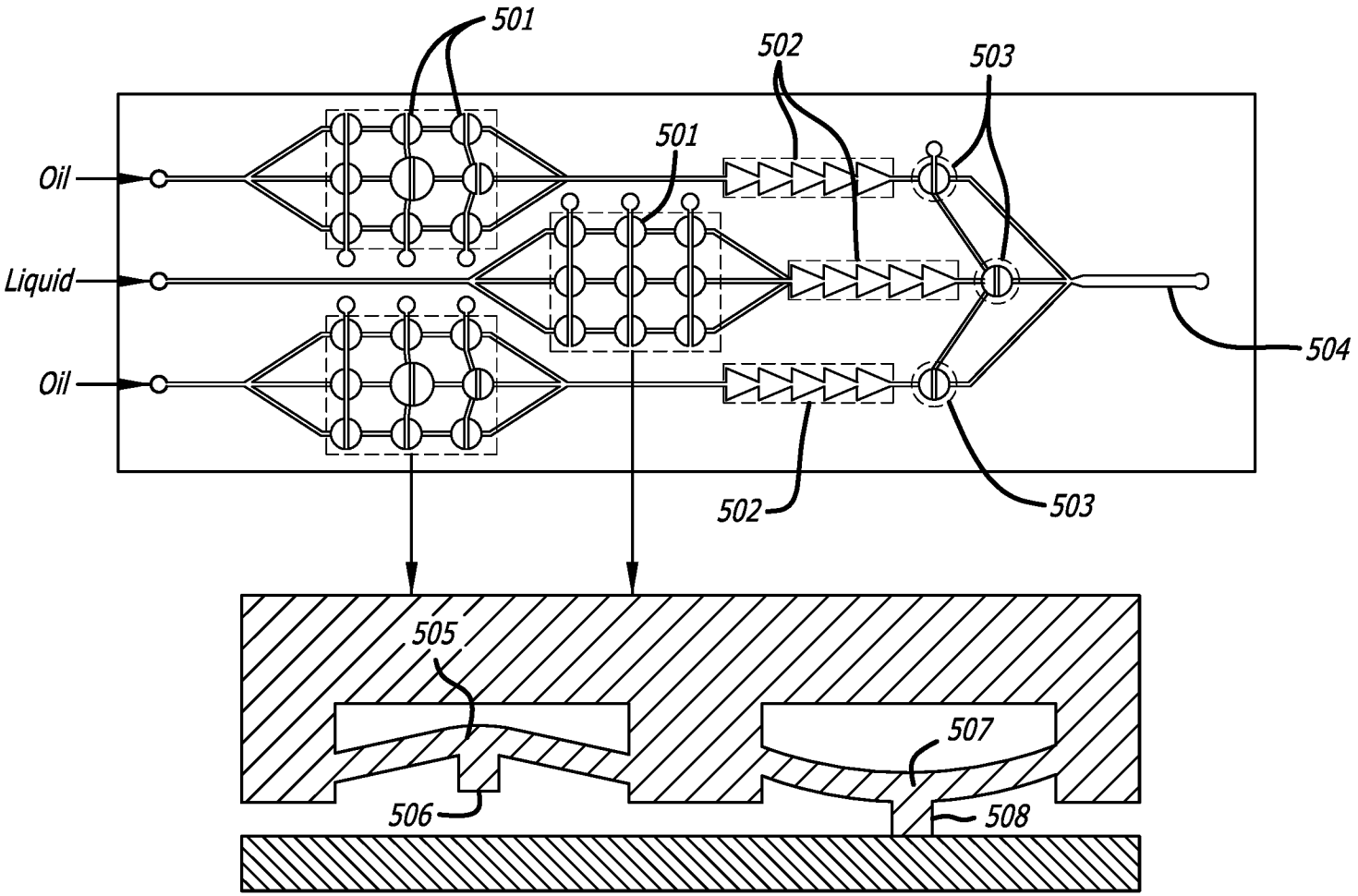
FIG. 5 depicts a schematic of a pneumatic pump which uses an open and close action having a diodic pump.

FIG. 5 presents a schematic of a droplet generator comprising a series of peristaltic pump system 501 distributed equally among three channels, each channel further comprising both and passive rectifier 502 and active rectifier 503. The peristaltic pump system 501, which uses an open and closed action of multiple valves or pumps, wherein during the open setting 505, 506, the pump allows fluid flow, and during the closed setting 507, 508, the pump prevents fluid flow. The present invention allows for multiple variations of pumps and valves, including quake valves, which utilized a membrane of an adjacent fluid flow valve, actuating similar to a conventional pinch valve. Additional pumps comprising bend actuators, or other finger actuators. Standard materials and membranes may be utilized, including polymeric layers and membranes comprised of polydimethylsiloxane (PDMS), thermoelastic layers such as titanium nitride, titanium aluminum nitride and vanadium-aluminum alloys for use in thermal bend actuators, and the like.

Figure 6A:
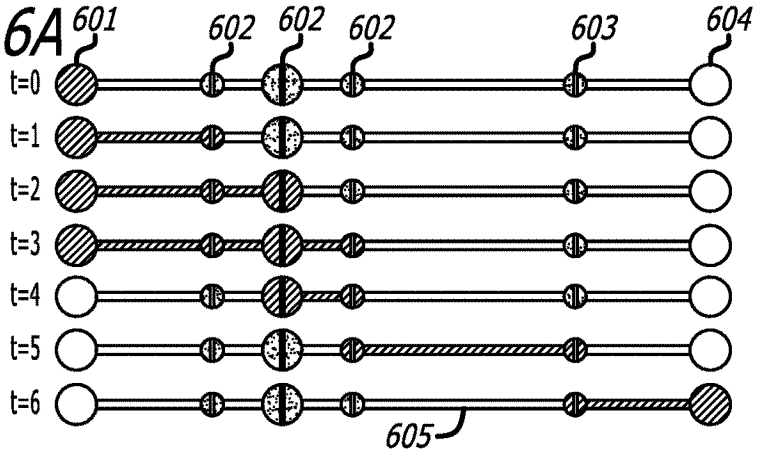
FIG. 6A depicts a schematic of a pneumatic pump having a continuous fill pumping sequence.
Figure 6B:
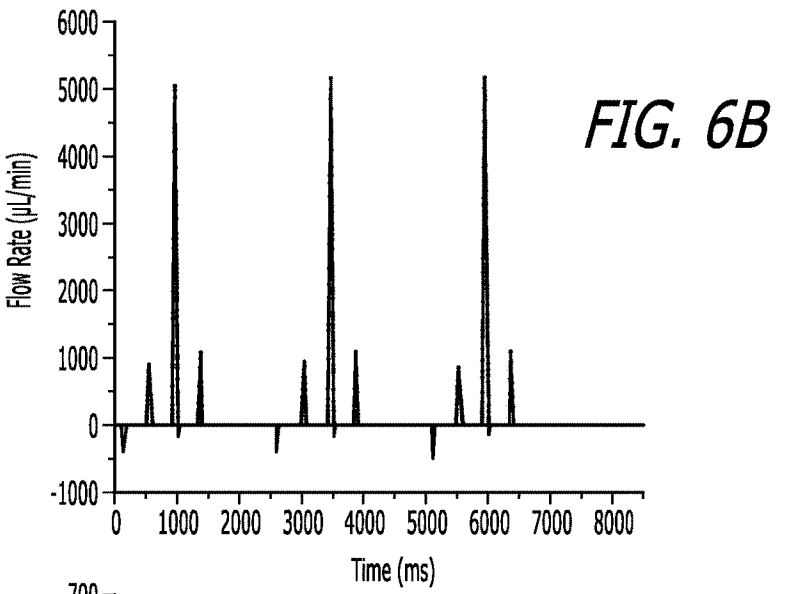
FIG. 6B depicts a graphical description of the volumetric flow profile of FIG. 6A without rectifiers.
Figure 6C:
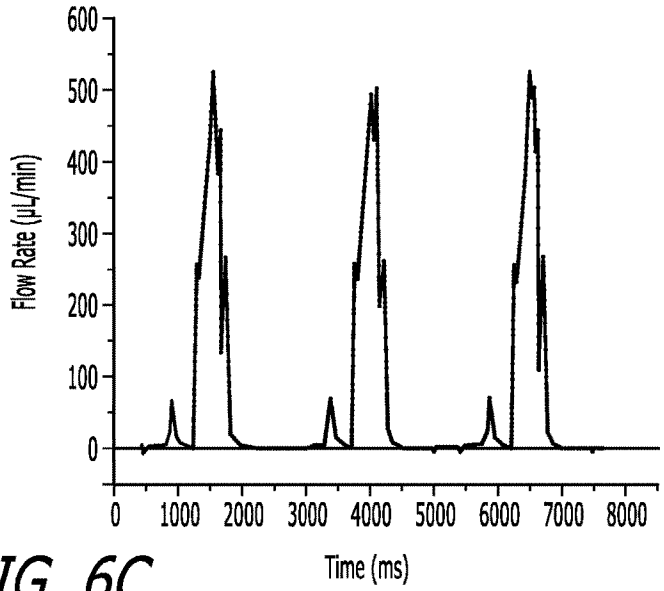
FIG. 6C depicts a graphical description of the volumetric flow profile of FIG. 6A with passive rectifiers and natural load on the active rectifier.
Figure 6D:
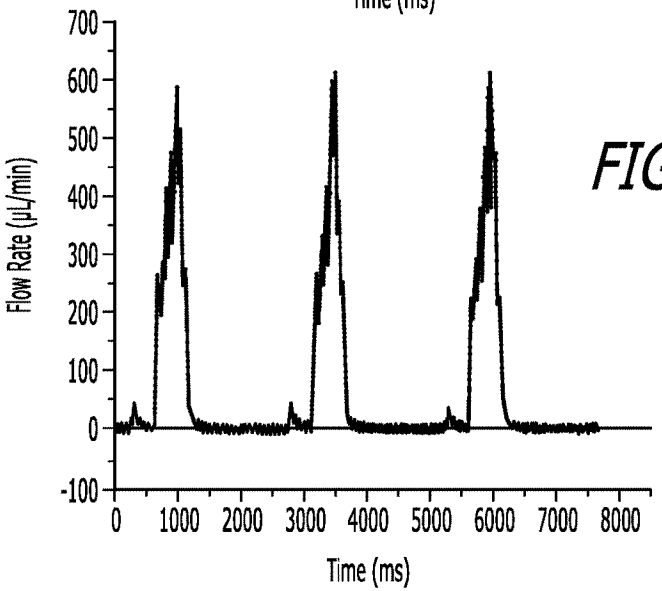
FIG. 6D depicts a graphical description of the volumetric flow profile of FIG. 6A with an active rectifier with 1 kPa pressure.

FIG. 6A presents a schematic of a pneumatic pump having pumping protocol for 400 ms actuation, with or without rectification, utilizing a continuous fill pumping sequence, comprising inlet 601, microvalves 602, channels 605, rectifiers 603, and outlets 604. In describing the flow rates, FIG. 6B shows the volumetric flow profile without any rectifiers. FIG. 6C shows the volumetric flow profile with the passive rectifier and natural load on the active rectifier. FIG. 6D shows the volumetric flow profile with an active rectifier with 1 kPa pressure, which was the limit of pressure capable of being applied to maintain 100% rectification of volumetric flow.

Figure 7A:
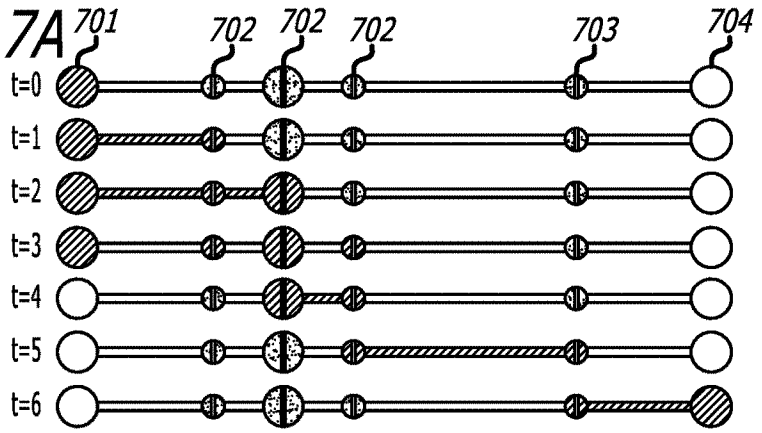
FIG. 7A depicts a schematic of a pneumatic pump having a discrete fill pumping sequence.
Figure 7B:
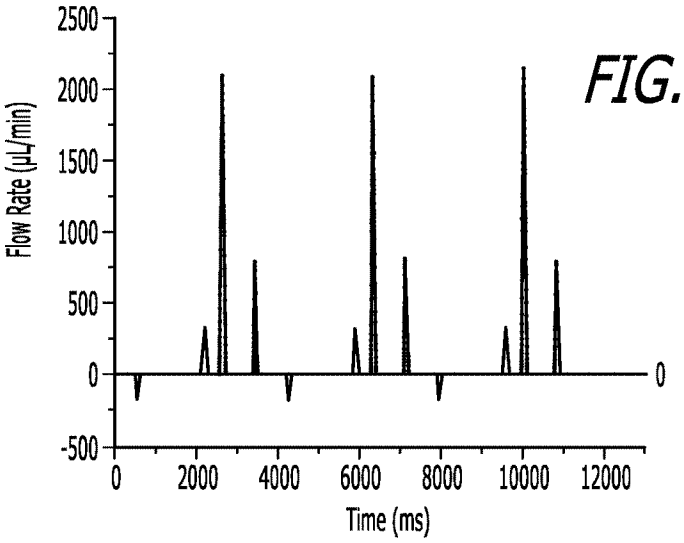
FIG. 7B depicts a graphical description of the volumetric flow profile of FIG. 7A without rectifiers.
Figure 7C:
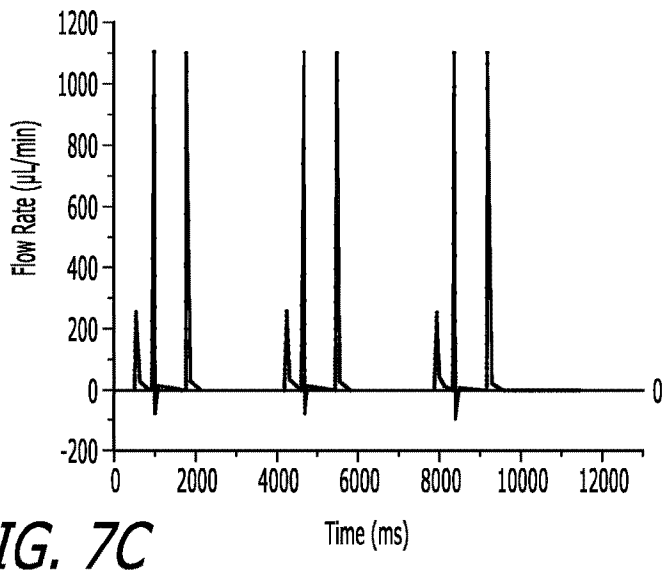
FIG. 7C depicts a graphical description of the volumetric flow profile of FIG. 7A with passive rectifiers and natural load on the active rectifier.
Figure 7D:
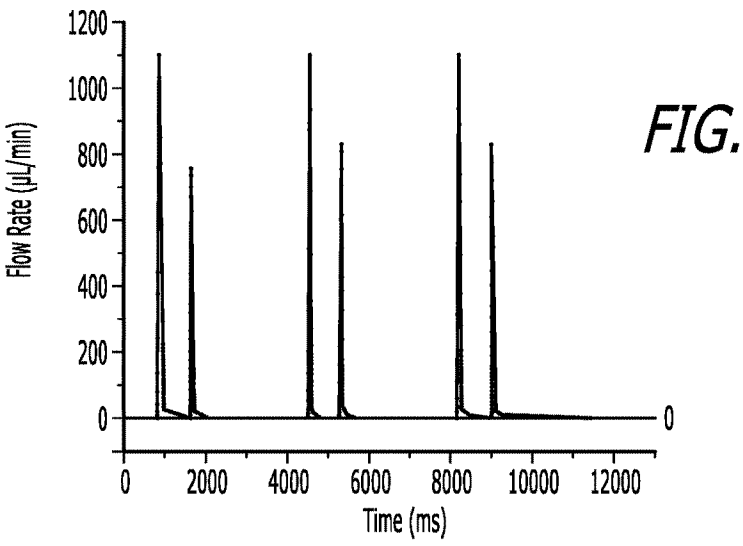
FIG. 7D depicts a graphical description of the volumetric flow profile of FIG. 7A with an active rectifier with 15 kPa pressure.

FIG. 6A presents a schematic of a pneumatic pump having pumping protocol for 400 ms actuation, with or without rectification, utilizing a discrete fill pumping sequence, comprising inlet 701, microvalves 702, rectifiers 703, and outlets 704. In describing the flow rates, FIG. 7B shows the volumetric flow profile without any rectifiers. FIG. 7C shows the volumetric flow profile with the passive rectifier and natural load on the active rectifier. FIG. 7D shows the volumetric flow profile with an active rectifier with 15 kPa pressure, which was the limit of pressure capable of being applied to maintain 100% rectification of volumetric flow.

While various embodiments have been described for purposes of this disclosure, such embodiments should not be deemed to limit the teaching of this disclosure to those embodiments. Various changes and modifications may be made to the elements and operations described above to obtain a result that remains within the scope of the systems and processes described in this disclosure.

Droplet generator by microfluidic devices may be carried out by continuous flow embodiments, in accordance with the following reference, which is considered exemplary, and is incorporated herein in its entirety: CONTINUOUS FLOW SEPARATIONS IN MICROFLUIDIC DEVICES, *Lab Chip* 2007, 7, 1644-1659. The fluidic rectifier of the present disclosure can be applied for any microfluidic applications requiring a continuous flow regime (which require syringe pumps).

Additional actuators may utilize the non-limiting embodiments of the following reference, incorporated herein in its entirety: ACTUATORS AND MICROFLUIDIC SINGLE or MULTINOZZLE(S) FOR 3D PRINTER. *Adv. Mater.* 2013, 25, 96-102/*Adv. Mater.* 2013, 25, 96-102.

Further non-limiting exemplary embodiments capable of utilizing the present invention include the following, incorporated herein in its entirety: IN-SITU HYDROGEL ARRAY FABRICATION BY LAMINAR FLOW REGIME WITH RECTIFIED PULSATILE MICROPUMP: Anal. Chem., Vol. 87, 3165-70, 2015/Biosensors and Bioelectronics, Volume 79, 15 May 2016, Pages 371-378.

Those skilled in the art will recognize that the devices, methods, and systems of the present disclosure may be implemented in many manners and as such are not to be limited by the foregoing exemplary embodiments and examples. Furthermore, the embodiments of methods presented and described in this disclosure are provided by way of example in order to provide a more complete understanding of the technology. The disclosed methods are not limited to the operations and logical flow presented herein. Alternative embodiments are contemplated in which the order of the various operations is altered and in which sub-operations described as being part of a larger operation are performed independently.

What is claimed is:

1. A device for performing a microfluidic assay on a chip comprising:

a microfluidics chip;

one or more fluid receptacles on the chip, each receptacle configured for receiving a single fluid, and each receptacle capable of being in fluid communication with a pressurized fluid source;

a plurality of pneumatic pumps arrayed on the chip, each pump being in fluid communication with one of the fluid receptacles via an incoming fluid channel, each pump having a discharge channel;

one or more rectifiers on the chip in fluid communication with the discharge channel from each pump; and a reaction chamber on the chip connected to and configured to communicate with one or more rectifier;

wherein a pressure from the pressurized fluid source drives the single fluid from each fluid receptacle into its incoming fluid channel and to its pump, through the pump and into its discharge channel, through the discharge channel to the one or more rectifiers, and through the one or more rectifiers into the reaction chamber;

wherein each pump is configured to generate droplets of the single fluid of a pre-determined size;

wherein the rectifiers prevent backflow of the droplets; and wherein droplets of the one or more fluids are combined in the reaction chamber, the chamber facilitating an assay being performed on the chip.

2. The device of claim 1, wherein the pneumatic pumps are pulsatile pumps.

3. The device of claim 1, wherein the droplets are of a size from low picoliters to high nanoliters.

4. The device of claim 1, wherein the assay being performed is a cell screening assay, a directed evolution assay, a nucleic acid analysis, immunoassay, or drug screening.

5. The device of claim 1, wherein each rectifier is a diodic rectifier.

6. The device of claim 1, wherein each discharge channel further comprises at least one passive rectifier.

7. The device of claim 1, wherein each discharge channel further comprises a plurality of passive rectifiers.

8. The device of claim 7, wherein the plurality of passive rectifiers is configured to prevent any backflow from being generated in the discharge channel.

9. The device of claim 1, wherein the pneumatic pump is a peristaltic pump.

10. The device of claim 1, wherein the pressurized fluid source further comprises a vacuum pump and a solenoid valve system.

11. The device of claim 10, wherein each rectifier is a diodic rectifier, each diodic rectifier being connected to a DC powered diodic pump configured to cause a pneumatic pressure on the rectifier.

12. The device of claim 1, further comprising a controller function, wherein the controller function is operated by a computer processor in a remote computer.

13. The device of claim 1, further comprising a monitoring function, wherein the monitoring function is operated by a computer processor in a remote computing device capable of sending or receiving signals.

* * * * *